United States Patent [19]

Bard

[11] Patent Number: 4,976,082

[45] **Date of Patent: * Dec. 11, 1990**

[54] NATURAL STONE PLATE HAVING HOLDING ELEMENTS PROVIDED ON THE SIDE FACING AWAY FROM THE VISIBLE SIDE

[75] Inventor: Martin Bard, Amberg, Fed. Rep. of Germany

[73] Assignee: Buchtal Gesellschaft mit Beschrankter Haftung, Schwarzenfeld, Fed. Rep. of Germany

[ * ] Notice: The portion of the term of this patent subsequent to Apr. 18, 2006 has been disclaimed.

[21] Appl. No.: 342,485

[22] Filed: Apr. 24, 1989

[30] Foreign Application Priority Data

May 6, 1988 [DE] Fed. Rep. of Germany ..... 3815552

[51] Int. Cl.[5] ..... E04F 13/08

[52] U.S. Cl. ..... 52/384; 52/386; 52/511

[58] Field of Search ..... 52/384, 386, 235, 511, 52/506, 509; 110/338, 339, 336

[56] References Cited

U.S. PATENT DOCUMENTS 4,821,478 4/1989 Cremer et al. ..... 52/384

*Primary Examiner*—Richard E. Chilcot, Jr.

*Attorney, Agent, or Firm*—Price, Heneveld, Cooper, DeWitt & Litton

[57] ABSTRACT

In a natural stone plate having holding elements provided on the side facing away from the visible side, said holding elements are attached to the stone plate by means of a glass solder. The coefficient of thermal expansion of the glass solder is approximately equal to that of the stone plate. Further, the holding elements are disposed on the stone plate at points of attachment determined according to static requirements.

20 Claims, 1 Drawing Sheet

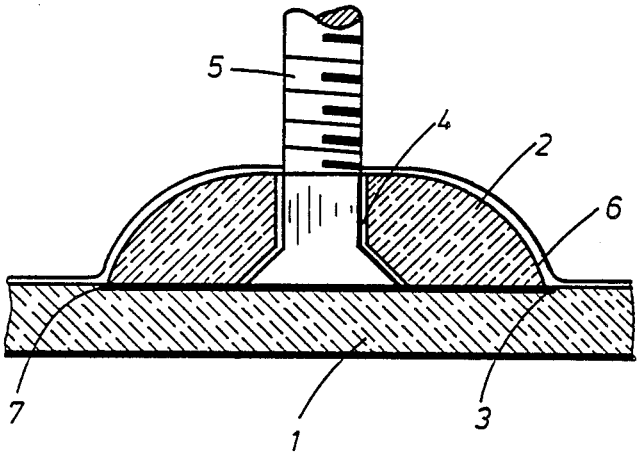
5
4
2
6
7
1
3

NATURAL STONE PLATE HAVING HOLDING ELEMENTS PROVIDED ON THE SIDE FACING AWAY FROM THE VISIBLE SIDE

The present invention relates to a natural stone plate having holding elements provided on the side facing away from the visible side.

In particular for lining the outside facades of large buildings, one often uses natural stone plates which must be attached to the facade by suitable attachment means. The type of attachment means is very important because large-format natural stone plates have a considerable weight, and if such a plate becomes detached from the facade structure the plate will not only be destroyed but above all constitute a considerable danger for persons and property.

For lining or inside walls of buildings, the stone plates are generally attached to the building by holding elements in the form of cliplike attachment elements. These clips are connected in a suitable way to the supporting structure of the building, on the one hand, and hold the plates at their edges in the selected position, on the other. The clips engage recesses provided for this purpose on the edges of the plates.

The technical requirements for such a facade lining depend on this static edge mounting and the expected wind forces, as well as on the combined effect of dimensions, thickness and weight. They also determine the costs for material and attachment. When very solid natural stones such as marble is used as a facade lining, it does not allow for a wall thickness smaller than 30 mm due to its material structure and its material properties as well as the above-mentioned edge mounting of the attachment elements, since otherwise there is a considerable risk of breakage. Since dimensions and wall thickness determine weight, the use of large-format stone plates for facades reaches a technical and financial limit at dimensions of approx. 500×1500 mm. This limit becomes more acute the higher the building and the wind load stressing.

For these cases as well as for applications involving normal requirements, solutions have been proposed for saving weight by joining stone plates with reduced wall thicknesses to thin-walled lightweight supporting plates made of other materials, such as aluminum, plastics or the like. This combination does lead to a tangible weight saving but makes it more difficult to produce such facade linings. As of larger formats of more than one square meter, the stone plate connected with the aluminum or plastics supporting plate by an adhesive tends to become detached and to break. This is mainly due to the fact that the supporting plate, when heated, expands more than the stone plate. The lifetime of such composite plates is thus limited.

For this reason one mainly uses the mechanical attachment means described at the outset for lining facades. Under dynamic loads due to the action of wind, however, the edge mounting of these mechanical attachment means can lead to the edges of the plates breaking out and being damaged or even to breakage of the plates themselves. One therefore usually uses the stone plates with excess thickness, but this increases their weight and thus necessitates accordingly dimensioned attachment means. Also, since the mechanical attachment means often engage in recesses in the edge area of the stone plate, so that the plate is weakened precisely in the endangered areas, the use of mechanical attachment elements limits the reduction of thickness of natural stone plates.

The invention is based on the problem of ensuring stable and reliable attachment of large-format natural stone plates.

This problem is solved according to the invention by the features contained in the characterizing part of claim 1.

According to the invention, holding elements are disposed on the back of the stone plate and connected thereto by means of a glass solder. Further, the holding means are disposed on the plate at points of attachment determined according to static requirements. The advantage of this attachment system is that the stone plate is completely unaffected by the attachment means themselves; in particular, the edge areas of the plate need not be weakened by recesses for inserting attachment means. Nevertheless, a homogeneous compound is achieved by the glass solder. The glass solder, that melts during the firing process, slightly dissolves the surfaces of the holding element and the stone plate in the attachment area, so that after cooling the holding element/glass solder and stone plate interlock. Further, this connection of the holding elements allows them to be disposed on the back of the stone plate at points determined according to static requirements. This allows altogether for the thickness of the stone plate to be reduced to a tolerable degree, without any danger of breakage being observed for the stone plates under dynamic loads due to the action of wind. The coefficient of thermal expansion shared by the glass solder establishing the bond and the plate material prevents cracks from arising in the case of temperature fluctuations. Such cracks are dangerous in particular in outside linings exposed to weather because rain that penetrates the cracks will impair the bond or can even destroy it in case of frost. The holding elements can be made of the same or a similar material to that of the plate and serve as such to attach the plate directly or each take up a metal attachment means. In the latter case, one is completely free in one's choice of material for the attachment means. A particularly suitable material for the holding elements has proven to be ceramic material.

It has surprisingly turned out that natural stone plates which are equipped in the proposed manner and have been subjected to a heating process in a firing oven show excellent strength properties of the bond between the holding element and the stone plate. Due to the quartz transition occurring during heating processes of quartz-containing substances at a temperature of 573° C., which can lead to crack formation in the quartz structure, one will attempt to perform this heating below this temperature. It is thus expedient to use a glass solder since it has a melting point below the quartz transition point.

The holding elements may be provided with recesses or bores for taking up metal attachment means, which makes it substantially easier to turn round inventive plates of this design on a framework or the like. The attachment means can be inserted into the holding elements even before firing. The resulting form closure between the holding element and the metal attachment means ensures a central load removal.

The firing can of course also occur without such metal attachment means if the recess or bore in the holding element is designed in a way that allows for metal attachment means to be introduced into the holding elements subsequently. Such attachment means can then be, for example, straddling dowels, insertion pins, spacers of the like. The invention thus provides a plate that can be directly attached to walls, cellings, holding frames or the like, whereby the points of attachment can be freely chosen according to static points of view. In an expedient embodiment the plate and holding element are made of the same material, giving rise to a homogeneous part having the same coefficient of thermal expansion and the same strength properties in the area of attachment of the holding elements. Even if the attachment means is made of metal, this does not alter the formation of a homogeneous body from the plate and holding element.

Since the connection of the holding element or attachment means to the plate takes place via the glass solder in a temperature range below the quartz transition point, both the holding element or attachment means and the stone plate are completely unchanged. The holding elements or attachment means are not located on the edge, but in those parts on the side of the plate facing away from the visible side which result in the statically best possibilities of attachment. The edge areas are thus completely unaffected by the holding system, thereby fundamentally avoiding the disadvantages involved in edge attachment for stone plates. In static terms, this allows for a transition from two-point mounting, as in the case of edge attachment, to multipoint mounting. The size and shape of the holding element base can be selected in such a way that the tension peaks arising in the mounting points do not exceed the tensions in the center of the field, i.e. the field bounded by the points of attachment. This allows for a tangible reduction in thickness of the stone plate.

Since it cannot always be ruled out that the plates on outside facades will be exposed to external effects such as rockfall or the like, it may be necessary to provide the side of the plate facing away from the visible side with a breakproof coating. This breakproof coating must cover at least the entire length of partial areas of a plate, so that in case of damage the parts of the plate cannot become detached from their compound and fall to the ground.

It may be advantageous to have the coating also cover the area of the holding elements, after which the glass solder bond is also protected from any atmospheric acid attack.

This breakproof coating preferably consists of a mineral fiber cloth or mat, preferably a glass cloth or mat, which is impregnated with an epoxy resin.

In particular if such a breakproof coating is used it is expedient, in a further embodiment of the invention, to design the holding elements not in the form of sharp-edged cuboids or cylinders but in a dome shape.

A further solution to this problem is to ensure that acidic rain or moisture can immediately flow out of the area of the ceramic bond. This is preferably done with the aid of channel-like recesses which extend from the edge of the holding element in the part intended to receive the metal attachment means, in at least one direction, preferably in four mutually perpendicular directions.

The present solution achieves a weight saving compared to edge-mounted possibilities of attachment of up to 50% for the weight of the stone plate.

In the following, a preferred exemplary embodiment of the invention shall be described with reference to the drawing, whose single figure shows a cross-section of a holding element on a natural stone plate.

In the FIG., 1 refers to a large-format natural stone plate, of which only part is shown. On the side opposite the visible side of stone plate 1 there is a holding element 2 which has a circular plan form in the embodiment shown. Holding element 2 is connected homogeneously to stone plate 1 via a glass solder 3. In a downwardly flaring central bore 4 in holding element 2 there is a countersunk screw 5 which serves as an attachment means and via which stone plate 1 can be attached to the facade. Finally, in the embodiment shown the back of the stone plate is provided with a breakproof coating which also extends at 6 over holding element 2, so that the bond between holding element 2 and stone plate 1 is protected in particular from atmospheric acid attack.

Holding elements 2 are disposed in particular in the edge area of the large-format plate, in particular in the corner area of the plate. Depending on the size of the large-format plate, more than four holding elements 2 can also be distributed along the periphery of the plate. Further, a depression 7 which serves to take up glass solder 3 can be worked into stone plate 1 in the area of the point of attachment of the holding element. A suitable glass solder is in particular a lead borate glass solder. The glass solder used is expediently a glass that softens and is sufficiently flowable at temperatures of about 400 to 450° C. (viscosity $\leqq 10^5$ dPa·s).

Holding elements 2 are provided on the back of stone plate 1 by laying a stone plate 1 on its visible side and placing glass solder 3 from above on the desired points of attachment of holding elements 2. Glass solder 3 may be pressed into an annular shape or else used in powder form. After placing on holding elements 2, which may be formed of natural stone or ceramic material, one performs a firing process, heating the stone plate with the holding elements placed thereon to a temperature below the quartz transition point. The glass solder melts and the adjacent surfaces of holding element 2 and stone plate 1 are superficially dissolved, so that during cooling the glass solder firmly interlocks with the adjacent surfaces of the holding element and stone plate 1, forming a homogeneous compound of these elements. Of course, if a countersunk screw is used as in the embodiment shown, the screw is inserted into appropriate bore 4 before holding elements 2 ae placed on the back of stone plate 1.

We claim:

1. A natural stone plate having holding elements provided on a side facing away from a visible side thereof, characterized in that the holding elements are attached to the stone plate by means of a glass solder whose coefficient of thermal expansion is approximately equal to that of the stone plate, and in that the holding elements are disposed on the plate at points of attachment determined according to static requirements.

2. The plate as in claim 1, characterized in that the holding elements include metal attachment means and nonmetal elements serving to take up said metal attachment means, and having a coefficient of thermal expansion at least approximating that of the stone plate.

3. The plate as in claim 1, characterized in that the holding elements are formed of a similar material to that of the stone plate.

4. The plate as described in claim 1, characterized in that the glass solder has a melting point below the quartz transition point of about 573° C.

5. The plate as described in claim 1, characterized in that the holding elements are provided with a bore adapted for taking up a metal attachment means.

6. The plate as described in claim 1, characterized in that the attachment means are each integrated in form-fitting fashion into the holding elements (2).

7. The plate as described in claim 1, characterized in that the side of the stone plate facing away from the visible side is provided with a breakproof coating (6) which covers the holding elements (2).

8. The plate as in claim 7, characterized in that the breakproof coating consists of a mineral fiber cloth or mat, preferably a glass cloth or mat, which is impregnated with an epoxy-resin.

9. The plate as described in claim 1, characterized in that the holding elements (2) have a circular plan form and a dome-shaped cross-section.

10. The plate as described in claim 5, characterized in that the holding elements have edges and are provided in at least direction with a channel extending from the edge of the holding element into the bore.

11. A method for producing a natural stone plate provided with holding elements, characterized in that a natural stone plate is provided having a side facing away from a visible side thereof, glass solder having a coefficient of thermal expansion approximately equal to that of the stone plate is provided on the side of the stone plate opposite the visible side at places intended for taking up the holding elements, the holding elements are then placed on the stone plate, the assembly consisting of the stone plate and the holding elements placed thereon is heated to a temperature below the quartz transition point until the glass solder melts, and is thereafter cooled.

12. The plate as described in claim 2, characterized in that the holding elements have edges and are provided in four mutually perpendicular directions with channels extending from the edge of the holding element into the part serving to take up the metal attachment means.

13. The plate as described in claim 2, characterized in that the holding elements have edges and are provided in at least one direction with channels extending from the edge of the holding element into the part serving to take up the metal attachment means.

14. The plate as in claoim 2, characterized in that the holding elements are formed of a similar material to that of the stone plate.

15. The plate as described in claim 2, characterized in that the glass solder has a melting point below the quartz transition point of about 573° C.

16. The plate as described in claim 5, characterized in that the glass solder has a melting point below the quartz transition point of about 573° C.

17. The plate as described in claim 10, characterized in that the glass solder has a melting point below the quartz transition point of about 573° C.

18. The method as described in claim 11, characterized in that the glass solder has a melting point below the quartz transition point of about 573° C.

19. The method as described in claim 11, characterized in that the holding elements are formed of a similar material to that of the stone plate.

20. The method as described in claim 18, characterized in that the holding elements are formed of a similar material to that of the stone plate.

* * * * *

UNITED STATES PATENT AND TRADEMARK OFFICE

CERTIFICATE OF CORRECTION

PATENT NO. : 4,976,082

DATED : December 11, 1990

INVENTOR(S) : Martin Bard

It is certified that error appears in the above-identified patent and that said Letters Patent is hereby corrected as shown below:

Column 1, Line 18
After "lining" insert --facades--

Column 3, Line 3
"cellings" should be --ceilings--

Column 4, Line 45
"ae placed" should be --are placed--

Column 5, Line 21
After "at least" insert --one--

Column 6, Line 13
"claoim" should be --claim--

Signed and Sealed this

Sixteenth Day of April, 1991

*Attest:*

HARRY F. MANBECK, JR.

*Attesting Officer*

*Commissioner of Patents and Trademarks*